United States Patent [19]

Light et al.

[11] Patent Number: 4,968,578

[45] Date of Patent: Nov. 6, 1990

[54] METHOD OF NON-ELECTROSTATICALLY TRANSFERRING TONER

[75] Inventors: William A. Light, Rochester; Donald S. Rimai, Webster; Louis J. Sorriero, Rochester, all of N.Y.

[73] Assignee: Eastman Kodak Company, Rochester, N.Y.

[21] Appl. No.: 345,160

[22] Filed: Apr. 28, 1989

Related U.S. Application Data

[63] Continuation-in-part of Ser. No. 230,381, Aug. 9, 1988.

[51] Int. Cl.[5] ..... G03G 13/14

[52] U.S. Cl. ..... 430/126

[58] Field of Search ..... 430/109, 126

[56] References Cited

U.S. PATENT DOCUMENTS

| | | | |
|---|---|---|---|
| 2,855,324 | 10/1958 | Van Dorn | 430/126 |
| 3,620,831 | 11/1971 | Gould | 430/135 |
| 3,958,990 | 5/1976 | Parent | 430/47 |
| 3,966,467 | 6/1976 | Parent | 430/47 |
| 4,014,696 | 3/1977 | Parent | 430/47 |
| 4,130,670 | 12/1978 | Gilliams et al. | 430/33 |
| 4,420,528 | 12/1983 | Okiyama | 428/220 |
| 4,464,453 | 8/1984 | Cooper et al. | 430/126 |
| 4,510,225 | 4/1985 | Kuehnle et al. | 430/126 |
| 4,529,650 | 7/1985 | Martinez | 428/336 |
| 4,599,293 | 7/1986 | Eckell et al. | 430/126 |
| 4,626,256 | 12/1986 | Kawasaki et al. | 8/471 |
| 4,657,557 | 4/1987 | Niwa et al. | 8/471 |

FOREIGN PATENT DOCUMENTS

| | | |
|---|---|---|
| 0078476 | 5/1983 | European Pat. Off. . |
| 0194776 | 9/1986 | European Pat. Off. . |

*Primary Examiner*—John L. Goodrow

*Attorney, Agent, or Firm*—Willard G. Montgomery

[57] ABSTRACT

Disclosed is an improved method of non-electrostatically transferring dry toner particles which comprise a toner binder and which have a particle size of less than 8 micrometers from an element to a receiver. The receiver comprises a substrate having a coating of a thermoplastic polymer thereon and a layer of a releasing agent on the coating, where the polymer has a $T_g$ less than 10° C. above the $T_g$ of the toner binder, and the release agent is present in an amount sufficient to prevent the polymer from adhering to the element. The receiver is heated to a temperature such that its temperature during transfer is above the $T_g$ of the polymer.

16 Claims, No Drawings

METHOD OF NON-ELECTROSTATICALLY TRANSFERRING TONER

RELATED APPLICATION

This application is a continuation-in part of our U.S. patent application Ser. No. 230,381; filed Aug. 9, 1988, and titled "Improved Method of Non-Electrostatically Transferring Toner".

TECHNICAL FIELD

This invention relates to an improved method of non electrostatically transferring toner particles having a particle size of less than 8 micrometers to a receiver. More particularly, it relates to such a method where the toner particles are contacted with a receiver which comprises a substrate coated with a thermoplastic polymer having a layer of a release agent on it, where the receiver is heated to a temperature such that its temperature during transfer is above the $T_g$ of the polymer.

BACKGROUND ART

In an electrostatographic copy machine an electrostatic latent image is formed on an element. That image is developed by the application of an oppositely charged toner to the element. The image-forming toner on the element is then transferred to a receiver where it is fixed. The transfer of the toner to the receiver is usually accomplished electrostatically, by means of an electrostatic bias between the receiver and the element.

In order to produce copies of very high resolution, it is necessary to use toner particles that have a very small particle size, i.e., less than about 8 micrometers. (Particle size herein refers to mean volume weighted diameter as measured by conventional diameter measuring devices such as a Coulter Multisizer, sold by Coulter, Inc. Mean volume weighted diameter is the sum of the mass of each particle times the diameter of a spherical particle of equal mass and density, divided by total particle mass.) However, it has been found that it is very difficult to electrostatically transfer such fine toners from the element to &he receiver, especially when they are less than 6 micrometers in diameter. That is, fine toner particles frequently do not transfer from the element with reasonable efficiency. Moreover, those particles which do transfer frequently fail to transfer to a position on the receiver that is directly opposite their position on the element, but rather, under the influence of coulombic forces, tend to scatter, thus lowering the resolution of the transferred image and increasing the grain and mottle.

In order to avoid this problem, it has become necessary to transfer the toner from the element to the receiver by non electrostatic processes. One such process is the thermally assisted transfer process where the receiver is heated, typically to about 60° to about 90° C., and is pressed against the toner particles on the element. The heated receiver sinters the toner particles, causing them to stick to each other and to the receiver, thereby effecting the transfer of the toner from the element to the receiver. The element and receiver are then separated and the toner image is fixed, e.g., thermally fused to the receiver. For details, see copending application Ser. No. 230,394, titled "Thermally Assisted Transfer of Small Electrostatographic Toner Particles" filed Aug. 9, 1988, and herein incorporated by reference.

While the thermally assisted transfer process does transfer very small particles without the scattering that occurs with electrostatic transfer processes, it may sometimes be difficult to transfer all of the toner particles by this process. The toner particles that are directly on the element often experience a greater attractive force to the element than they do to the receiver and to other toner particles that are stacked above them, and the heat from the receiver may have diminished to such an extent by the time it reaches the toner particles next to the element that it does not sinter them. As a result, the toner particles that are in contact with the element may not transfer. Attempts to solve this problem by coating the element with a release agent have not proved to be successful because the process tends to wipe the release agent off the element into the developer, which degrades both the developer and the development process.

An alternative approach to removing all of the toner particles from the element is to use a receiver that has been coated with a thermoplastic polymer. During transfer the toner particles adhere to or become partially embedded in the thermoplastic coating and are thereby removed from the element. However, it has been found that many thermoplastics that are capable of removing all of the toner particles also tend to adhere to the element. This, of course, not only seriously impairs image quality but it may also damage both the element and the receiver. Until now no good solution has been found to this problem.

DISCLOSURE OF INVENTION

We have found that if a toner is transferred to a receiver formed of a substrate coated with a thermoplastic polymer and a layer of a release agent on the thermoplastic coating, where the receiver is heated above the $T_g$ of the polymer, the release agent will prevent the thermoplastic polymer from adhering to the element but it will not prevent the toner from transferring to the receiver, and virtually all of the toner will transfer to the receiver. This is a surprising result because release agents are typically applied to an element to prevent a toner from adhering to the element, so one could reasonably expect that the application of a release agent to a receiver would prevent a toner from adhering to the receiver, resulting in poorer transfer instead of &he improved transfer which was actually observed.

By transferring toner using that particular heated receiver we are able to obtain the high image quality that is not available when very small particles are transferred electrostatically, but we avoid the above described problem of incomplete transfer which may sometimes be associated with a thermally assisted transfer process. We have also found that copies made using the transfer process of this invention can be given a more uniform gloss because all of the receiver is coated with a thermoplastic polymer, (which can be made glossy) while, in receivers that are not coated with a thermoplastic polymer, only those portions of the receiver that are covered with toner can be made glossy and the level of gloss varies with the amount of toner. Another advantage of the process of this invention is that when the toner is fixed it is driven more or less intact into the thermoplastic coating, rather than being flattened and spread out over the receiver, and this also results in a higher resolution image and less grain. Finally, we have found that in the process of this invention, light tends to reflect from behind embedded toner particles that are in the thermoplastic layer, which causes the light to diffuse more, making the image appear less grainy.

BEST MODE FOR CARRYING OUT THE INVENTION

In the method of this invention, the transfer of toner particles from an element to a receiver is accomplished non electrostatically using a receiver which comprises a substrate, a coating of a thermoplastic polymer on the substrate, and a layer of a release agent on the coating. The receiver is heated to a temperature such that its temperature during transfer is above the glass transition temperature, $T_g$, of the polymer. Due to the presence of the release agent, the element can be separated from the receiver at a temperature above the $T_g$ of the polymer without having the polymer adhere to the element. Heating the receiver to a temperature above the $T_g$ of the polymer can be accomplished by a variety of methods such as radiant heat in an oven or contacting the receiver with a heated roller or a hot shoe. Preferably, the front surface of the receiver is heated to about 60° to about 90° C.

Almost any type of substrate can be used to make the coated receiver used in this invention, including paper, film, and particularly transparent film, which is useful in making transparencies. The substrate must not melt, soften, or otherwise lose its mechanical integrity during transfer or fixing of the toner. A good substrate should not absorb the thermoplastic polymer, but should permit the thermoplastic polymer to stay on its surface and form a good bond to surface. Substrates having smooth surfaces will, of course, result in a better image quality. A flexible substrate is particularly desirable, or even necessary, in many electrostatographic copy machines. A substrate is required in this invention because the thermoplastic coating must soften during transfer and fixing of the toner particles to the receiver, and without a substrate the thermoplastic coating would warp or otherwise distort, or form droplets, destroying the image.

Any good film forming thermoplastic polymer can be used to form a thermoplastic coating on the substrate. The thermoplastic coating must be sufficiently adherent to the substrate so that it will no& peel off when the receiver is heated. It must also be sufficiently adherent to the toner so that transfer of the toner occurs. The thermoplastic coating should also be abrasion resistant and flexible enough that it will not crack when &he receiver is bent. A good thermoplastic polymer should not shrink or expand very much, so that it does not warp the receiver or distort the image, and it is preferably transparent so that it does not detract from the clarity of the image. The thermoplastic polymer must have a $T_g$ less than 10° C. above the $T_g$ of the toner binder, which preferably has a $T_g$ of about 60° to about 100° C., so that the toner particles can be pressed into the surface of the thermoplastic coating during transfer. Preferably, the $T_g$ of the thermoplastic polymer is below the $T_g$ of the toner binder, but polymers having a $T_g$ up to 10° C. above the $T_g$ of the toner binder can be used at higher nip speeds where the toner is removed from the nip before it can melt. Melting of the toner in the nip should be avoided as it may cause the toner to adhere to the element or to damage the element. Since fixing of the toner on the receiver usually requires the fusing of the toner, fixing occurs at a higher temperature than transfer (when they are separate steps), and fixing softens or melts both the toner and the thermoplastic coating.

Either condensation or addition polymers can be used as the film-forming polymer, and it is often useful to form a blend of various polymers in order to obtain the most desirable properties. A good thermoplastic polymer preferably has a surface energy (which is determined by conventional means) of about 40 to about 60 dynes/centimeter. Thermoplastic polymers having a lower surface energy may not pick up all of the toner from the element and thermoplastic polymers having greater surface energies may tend to stick to the element. A preferred weight average molecular weight for the thermoplastic polymer is about 20,000 to about 500,000. If a condensation polymer is used the preferred weight average molecular weight range is about 20,000 to about 80,000, and if an addition polymer is used the preferred weight average molecular weight is about 50,000 to about 500,000. Lower molecular weight polymers may have poorer physical properties and may be brittle and crack, and higher molecular weight polymers may have poor flow characteristics and do not offer any significant additional benefits for the additional expense incurred. A suitable $T_g$ for the polymer is about 40° to about 80° C., and preferably about 45 to about 60, as polymers having a lower T may be too soft in warm weather, and polymers having a higher $T_g$ may not soften enough to pick up all of the toner. The thermoplastic polymer is preferably amorphous as amorphous polymers are readily available and work well, but some crystalline polymers are also suitable if they have the aforementioned properties. Other desirable properties include thermal stability and resistance to air oxidation and discoloration.

The thermoplastic coating on the receiver can be formed in a variety of ways, including solvent coating, extruding, and spreading from a water latex. Extrusion is preferred because no solvent is present. The resulting thermoplastic coating on the substrate is preferably about 2 to about 20 micrometers in thickness as thinner layers may be insufficient to transfer all of the toner from the element and thicker layers are unnecessary and may result in warpage of the receiver, may tend to delaminate, may embrittle, or may result in a loss of image sharpness.

Suitable thermoplastic materials include polyesters, polystyrenes, polystyrene-acrylics, polymethyl methacrylate, polyvinyl acetate, polyolefins, and copolymers such as polyvinylethylene-co-acetate, polyethylene-co-acrylics, amorphous polypropylene, and copolymers and graft copolymers of polypropylene. The preferred thermoplastic material is a blend of polyesters.

The release agent may be defined as a coatable material that has a very low surface energy, preferably less than 40 dynes/cm. In order to prevent the release agent from wetting the photoconducting element and adhering to it, the release agent should preferably have a lower surface energy than the element. Many elements are made with polyester binders and have low surface energies of approximately 45 dynes/cm. Many compounds that are conventionally used as release agents are not suitable for use in this invention because their surface energies are too high. A suitable release agent should also stay on or near the surface of the thermoplastic coating and should not penetrate into the thermoplastic coating in significant concentrations or weaken the bonding of the thermoplastic coating to the substrate. However, the release agent should not be chemically reactive with the thermoplastic as we have found that release agents that are chemically reactive with the thermoplastic do not work well. Suitable release agents are nonpolar compounds such as hydrophobic metal salts of organic fatty acids, for example, zinc stearate, nickel stearate, and zinc palmitate, siloxane copolymers such as poly[4,4'-isopropylidene-diphenylene-co-block-poly-(dimethylsiloxanediyl) sebacate, fluorinated hydrocarbons, perfluorinated polyolefins, and semi-crystalline polymers such as polyethylene, polypropylene, and a variety of polyesters.

The layer of release agent can be formed on the thermoplastic layer by solvent coating, rubbing on a powdered or liquid release agent, or other method. The preferred method, however, is to apply both the release agent and thermoplastic polymer together to the substrate. This can be done by dissolving both the thermoplastic polymer and the release agent in a non-polar solvent, if the release agent has a lower surface energy, so that the release agent comes to the surface of the thermoplastic coating as the solvent evaporates. A solution where the release agent is about 1 to about 5% of the weight of the thermoplastic polymer is suitable. However, formation of the layer of release agent is preferably accomplished by mixing the release agent into a melt with the thermoplastic polymer and extruding the melt directly onto the substrate. Such a melt might comprise about 1 to about 5% by weight of the release agent and about 95 to about 99% by weight of the thermoplastic polymer. As the melt solidifies on the substrate the release agent comes to the surface because the energy of the surface thus formed is lower. If the release layer is applied over the thermoplastic coating it is preferably about 30Å to about 1 micrometer thick because thinner layers may not prevent the thermoplastic coating from adhering to the element, and the toner may not penetrate into the thermoplastic coating if the layer is thicker.

The polymers useful as toner binders in the practice of the present invention can be used alone or in combination and include those polymers conventionally employed in electrostatic toners. Useful polymers generally have a $T_g$ between 50° and 120° C. Preferably, toner particles prepared from these polymers have a relatively high caking temperature, for example, higher than about 60° C., so that the toner powders can be stored for relatively long periods of time at fairly high temperatures without having individual particles agglomerate and clump together. The melting point of useful polymers preferably is within the range of from about 65° C. to about 200° C. so that the toner particles can readily be fused to the receiver to form a permanent image. Especially preferred polymers are those having a melting point within the range of from about 65° to about 120° C.

Useful polymers having the above-described physical properties include polymeric esters of acrylic and methacrylic acid such as poly(alkyl acrylate), and poly(alkyl methacrylate) wherein the alkyl moiety can contain from 1 to about 10 carbon atoms. Other useful polymers are various styrene containing polymers. Such polymers can comprise, e.g., a polymerized blend of from about 40 to about 100% by weight of styrene, from 0 to about 45% by weight of a lower alkyl acrylate or methacrylate having from 1 to about 4 carbon atoms in the alkyl moiety such as methyl, ethyl, isopropyl, butyl, etc. and from about 5 to about 50% by weight of another vinyl monomer other than styrene, for example, a higher alkyl acrylate or methacrylate having from about 6 to 20 or more carbon atoms in the alkyl group. Typical styrene-containing polymers prepared from a copolymerized blend as described hereinabove are copolymers prepared from a monomeric blend of 40 to 60% by weight styrene or styrene homolog, from about 20 to about 50% by weight of a lower alkyl acrylate or methacrylate and from about 5 to about 30% by weight of a higher alkyl acrylate or methacrylate such as ethylhexyl acrylate (e.g., styrene-butyl acrylate-ethylhexyl acrylate copolymer). Preferred fusible styrene copolymers are those which are covalently crosslinked with a small amount of a divinyl compound such as divinylbenzene. A variety of other useful styrene-containing toner materials are disclosed in U.S. Pat. Nos. 2,917,460; Re 25,316; 2,788,288; 2,638,416; 2,618,552 and 2,659,670. Various kinds of well-known addenda (e.g., colorants, charge control agents, etc.) can be incorporated into the toners.

The element from which the toner particles are transferred include any of the electrostatographic elements well known in the art, including electrophotographic or dielectric recording elements. Examples of such elements can be found in U.S. Pat. Nos. 4,175,960 and 3,615,414.

The following examples further illustrate this invention:

EXAMPLE 1

A polyester blend, having a $T_g$ of 50° C. and a weight average molecular weight of about 30,000, a condensation co-polymer of 50 mole percent terephthalic acid reacted with a 50—50 mole percent mixture of neopentyl glycol and diethylene glycol, and 50 mole percent of terephthalic acid reacted with a 90-10 mole percent mixture of neopentyl glycol and diethylene glycol, was dissolved in methylene chloride containing 0.24% by weigh& (based on entire solution weight) polymethylphenylsiloxane having a methyl to phenyl ratio of 23:1 sold by Dow-Corning Company under the trade designation "DC 510," forming a 10% by weight solution of the polyester. A polyethylene coated flexible paper, which had been corona treated to increase surface tension and therefore adhesion, was coated with the solution and the solvent was evaporated to form a polyester coating on the paper 10 micrometers thick. The "DC510" came to the surface of the polyester coating and formed a layer which had a surface energy of 38 dynes/cm. The receiver was used in an electrographic apparatus as described in U.S. Pat. No. 4,473,029 issued Sept. 25, 1984. The machine had a conventional organic photo-conductor in a polyester binder which had a surface energy of 45.2 dynes/cm. No electrostatic bias was present between the receiver and the photoconductive element. A styrene-butylacrylate toner having a $T_g$ of 62° C. and a particle size of 3.5 micrometers was used in the process. The front surface of the receiver was heated to about 80° C. prior to the transfer. That surface was contacted with the toner particles on the surface of the photoconductive element and the particles transferred to the receiver. The receiver and the photoconductive element were separated immediately after transfer and prior to fixing the transferred image. After transfer the toner was fixed by exposure to dichloromethane vapors.

Transfer was very good and the element readily separated from the receiver after the transfer process was completed. The transfer efficiency, i.e., the percentage of toner that transferred from the element to the receiver, was approximately 100%.

EXAMPLE 2

Example 1 was repeated except that the concentration of "DC 510" was reduced to 0.03%, which is a typical concentration when used as a coating surfactant. This amount of release agent was insufficient to prevent the polyester from sticking to the photoconductive element and the element, receiver, and image were all permanently damaged during separation. This example does not fall within the scope of this invention because &he concentration of release agent at the surface of the thermoplastic coating was insufficient.

A second receiver, made from the same solution, was coated with zinc stearate prior to transfer by sprinkling zinc stearate powder, which had a surface energy of approximately 20 dynes/cm, onto the receiver and buffing it with cotton pads, forming a layer of release agent having a total thickness of approximately 50 Å. Good transfer (i.e., transfer efficiency=about 100%) and release were obtained with the second receiver

EXAMPLE 3

The first part of Example 2 was repeated except that instead of using "DC 510" as the release agent, the release agent was poly(bisphenol A)-block-poly(dimethylsiloxane) adipate at a concentration of 0.03%, which had a surface energy of approximately 35 dynes/cm and is sold by Eastman Kodak Company under the trade designation "Adipate." The element adhered to the receiver during transfer. After they were separated the receiver was damaged, which resulted in the failure to transfer all the toner. Transfer efficiency varied greatly, depending upon the nature of the damage during separation. This example does not fall within the scope of this invention because the concentration of "Adipate" at the surface was insufficient to effect release.

EXAMPLE 4

Example 1 was repeated except that the receiver substrate was a flexible polyethylene terephthalate film base sold by Eastman Kodak Company under the trade designation "Estar 427" and the "DC 510" was replaced with "Adipate" at a concentration of 0.24%. Transfer efficiency was greater than 99% and the receiver and element readily separated. The resulting image was suitable for use as a high quality transparency.

EXAMPLE 5

Example 1 was repeated except that the "DC 510" was replaced with "Adipate" at a concentration of 0.24%, and the toner was a polyester toner having a $T_g$ of approximately 60° C. and a particle size of 3.5 micrometers. Good transfer (i.e., transfer efficiency=100%) and release were obtained.

EXAMPLE 6

Example 1 was repeated except that the "DC 510" was replaced with "Adipate" at a concentration of 0.24%, and the substrate was a 254 micrometer thick flexible polyethylene coated paper. Transfer and release were good (i.e., transfer efficiency=100%).

EXAMPLE 7

Example 6 was repeated except that the substrate consisted of a flexible graphic arts paper, "Navajo Fieldstone Cover." The thermoplastic coating was absorbed by the paper during the coating operation. The receiver separated readily from the element but transfer efficiency was very low (i.e., less than 30%). This example does not fall within the scope of this invention because the thermoplastic was absorbed by the paper rather than forming a coating on the surface of the paper.

EXAMPLE 8

Example 7 was repeated except that the substrate consisted of a flexible clay coated graphics art paper, 6 pt. "Kromekote" sold by Champion. The thermoplastic polymer was not absorbed by the paper, but remained principally on the surface. Transfer and separation were good (i.e., 100%). Image quality was surprisingly good which was attributed to the fact that the thermoplastic coating smoothed the surface of the paper.

EXAMPLE 9

This is a comparative example outside the scope of this invention which illustrates the necessity of using a receiver within the scope of this invention to obtain good transfer of a small particle toner in a thermally assisted transfer process. Example 8 was repeated except that no thermoplastic coating was used and no release agent was used. Transfer efficiency was very poor (i.e., less than 30%).

EXAMPLE 10

Example 1 was repeated except that the thermoplastic polymer consisted of a styrene butylacrylate copolymer having a $T_g$ of 48° C. and a weight average molecular weight of 150,000 and "Adipate" at a concentration of 0.24% was used as a release agent instead of "DC 510." This resulted in a thermoplastic coating 10 micrometers thick having thereon a layer of release agent. The copolymer was coated onto a 254 micrometer thick flexible polyethylene coated paper. Transfer was good (i.e., transfer efficiency=100%) and the receiver and element readily separated.

EXAMPLE 11

Example 10 was repeated except that a commercially available styrene butylacrylate copolymer having a $T_g$ of 46° C. and a weight average molecular weight of 150,000, sold by Goodyear under the trade designation "Pliotone 2102," was used as the thermoplastic polymer. The thermoplastic coating was 10 micrometers thick. Good transfer (i.e., transfer efficiency=greater than 98%) and separation were obtained.

EXAMPLE 12

Example 1 was repeated except that the thermoplastic polymer was a copolymer of 50 weight percent styrene and 50 weight percent 2-hydroxyethylmethacrylate containing 15% by weight polysiloxane having a $T_g$ of 46° C. and a weight average molecular weight of 200,000, and the substrate was flexible 254 micrometer thick polyethylene coated paper. The thermoplastic coating was 10 micrometers thick. The polysiloxane release agent did not rise to the surface of the thermoplastic coating but remained dispersed throughout the coating. The receiver and element readily separated, but transfer efficiency was very poor (i.e., less than 1%). This example does not fall within the scope of this invention because the release material was dispersed throughout the thermoplastic rather than forming a coating on its surface.

EXAMPLE 13

Example 6 was repeated except that the transferred toner image was fixed by passing it through the nip of two rolls as illustrated in U.S. Pat. No. 4,473,029, issued Sept. 25, 1984. The temperature of the fuser roll contacting the toner image was 110° C. and the pressure was 758.45 kPa. Substantially 100% transfer efficiency was achieved as in Example 6 and release was excellent.

INDUSTRIAL APPLICABILITY

The coated receiver of this invention can be used in any electrostatographic process including electrophotographic processes, where the electrostatic image is formed using light, and dielectric recording, where the electrostatic image is formed electronically. It can be used both in processes where the electrostatic image is developed using a dry toner, and also in processes where the image is developed using a liquid developer and the toner is dried on the element.

The invention has been described in detail with particular reference to preferred embodiments thereof, but it will be understood that variations and modifications can be effected within the spirit and scope of the invention.

What is claimed is:

1. A method of non-electrostatically transferring dry toner particles which comprise a toner binder and which have a particle size of less than 8 micrometers from an element to a receiver comprising (A) contacting said toner particles with a receiver which comprises
  (1) a substrate;
  (2) a coating of a thermoplastic polymer on the surface of said substrate, where said thermoplastic polymer has a $T_g$ less than 10° C. above the $T_g$ of toner binder; and
  (3) a layer of a release agent on the surface of said coating in an amount sufficient to prevent said thermoplastic polymer from adhering to said element during said transferring;

(B) heating said receiver to a temperature such that its temperature during said transferring is above the $T_g$ of said thermoplastic polymer; and (C) separating said receiver from said element at a temperature above the $T_g$ of said thermoplastic polymer.

2. A method according to claim 1 wherein said substrate is paper.

3. A method according to claim 1 wherein said substrate is a transparent film.

4. A method according to claim 1 wherein said substrate is flexible.

5. A method according to claim 1 wherein said toner particles are transferred to said receiver from a photoconductive element which comprises a polyester binder.

6. A method according to claim 1 wherein said coating is about 2 to about 20 micrometers thick.

7. A method according to claim 1 wherein said layer of release agent is formed by applying said release agent onto said coating and said layer of release agent is about 30 angstroms to about 1 micrometer thick.

8. A method according to claim 1 wherein said coating of said thermoplastic polymer and said layer of release agent are formed on said substrate from a solution comprising a solvent, said thermoplastic polymer, and said release agent, where said release agent is about 1 to about 5 weight percent of the weight of said thermoplastic polymer.

9. A method according to claim 1 wherein said layer of release agent is formed by extruding a melt of about 95 to about 99% by weight of said thermoplastic polymer and about 1 to about 5% by weight of said release agent onto said substrate.

10. A method according to claim 1 wherein said release agent has a surface energy of less than 40 dynes/cm.

11. A method according to claim 1 wherein the front surface of said receiver is heated to about 60° to about 90° C.

12. A method according to claim 1 wherein said release agent has a lower surface energy than said element.

13. A method according to claim 1 wherein said thermoplastic polymer has a surface energy of about 40 to about 60 dynes/cm, a weight average molecular weight of about 20,000 to about 500,000, and a $T_g$ of about 40° to about 80° C.

14. A method according to claim 13 wherein said $T_g$ is about 45° to about 60° C.

15. A method according to claim 13 wherein said thermoplastic polymer is a condensation polymer and has a weight average molecular weight of about 20,000 to about 80,000.

16. A method according to claim 13 wherein said thermoplastic polymer is an addition polymer and has a weight average molecular weight of about 50,000 to 500,000.

* * * * *